US005476256A

United States Patent [19]

Fortuna et al.

[11] Patent Number: 5,476,256

[45] Date of Patent: Dec. 19, 1995

[54] DISK STACKER INCLUDING PASSIVE SHEET REGISTRATION ASSIST SYSTEM

[75] Inventors: Sixto M. Fortuna, Webster; Luis A. Santiago, Rochester, both of N.Y.

[73] Assignee: Xerox Corporation, Stamford, Conn.

[21] Appl. No.: 282,377

[22] Filed: Jul. 29, 1994

[51] Int. Cl.[6] ..... B65H 29/00

[52] U.S. Cl. ..... 271/187; 101/415.1; 271/315

[58] Field of Search ..... 271/187, 315, 271/82, 85, 268; 101/409, 410, 411, 412, 415.1

[56] References Cited

U.S. PATENT DOCUMENTS

| | | | |
|---|---|---|---|
| 5,065,997 | 11/1991 | Butts et al. | 271/187 |
| 5,114,135 | 5/1992 | Evangelista et al. | 271/187 |
| 5,280,901 | 1/1994 | Smith et al. | 271/188 |

FOREIGN PATENT DOCUMENTS

| | | | |
|---|---|---|---|
| 1500227 | 11/1967 | France | 271/82 |
| 2168686 | 6/1986 | United Kingdom | 271/187 |

*Primary Examiner*—William E. Terrell
*Assistant Examiner*—Carol L. Druzbick
*Attorney, Agent, or Firm*—Denis A. Robitaille

[57] ABSTRACT

A disk-type sheet inverting and stacking system in which a rotatable disk unit includes a receiving slot for having the lead edge of a sheet substrate inserted therein such that rotational movement of the disk unit inverts the sheet and delivers it to a stacking tray. The disk-type inverting and stacking system also includes a passive sheet registration system for restraining movement of a sheet positioned in the receiving slot by providing a reciprocating boss member in a retaining cavity on the disk unit, such that the reciprocating member can be shifted, under the influence of gravity, from a non-operative position extending into the slot with a sheet positioned therein, for applying a normal force against the sheet in response to rotational movement of the disk unit.

18 Claims, 5 Drawing Sheets

DISK STACKER INCLUDING PASSIVE SHEET REGISTRATION ASSIST SYSTEM

The present invention relates generally to an apparatus for sequentially transporting and stacking sheets and, more particularly, to a disk-type sheet inverter/stacker including a passive registration assist system for stacking and aligning output copy sheets from a printing or copying machine.

In many automatic copying or printing machines, a rotating disk stackers are often utilized for providing combined sheet inversion and stacking of output copy sheets. In a typical rotating disk stacker, copy sheets are sequentially transported into an arcuate receiving slot on a rotating disk. The copy sheet lead edge is inserted into the receiving slot and the copy sheet is temporarily maintained in contact with the rotating disk such that the rotating movement of the disk flips the sheet over and simultaneously guides the inverted sheet into a collecting tray. Inverted sheet stacking devices of this type, sometimes referred to as "windsor stackers", are well known and have been disclosed, for example, in commonly assigned U.S. Pat. Nos. 4,385,756; 5,058,880; 5,065,996; and 5,114,135, among others.

The described sheet stacking mechanism advantageously provides a simple system for implementing desirable collated stacking, forward or so-called 1 to N order printing, and is capable of inverting and stacking sheets of varying sizes and weights which may be supplied at high speeds. Preferably, such disk-type stacking systems are also capable of aligning sheets in a stack so that the front and side edges of each sheet are precisely aligned. Preferably sheet stacking systems of this nature should also have the capability to offset individual sets of copy sheets from one another for providing a method for distinguishing individual sets of documents (which may be made up of multiple sheets) from one another while maintaining the alignment of sheets within each set. To this end, some disk stackers also provide a side tamping device for placing output sheets in a flush configuration while laterally offsetting separate print jobs.

Despite the fact that such disk-type sheet stacking devices have been successfully incorporated into commercial applications, as for example, in the Xerox Corporation "4135" high speed laser printer, among others it is desirable to provide an improved sheet stacking apparatus which is capable of stacking a wide variety of copy sheets having various sizes and weights while maintaining reliable sheet handling and registration or alignment capabilities at high speeds. In particular, increased printing speeds has revealed that the rotating transport process inherently introduces an undesirable variation in the placement of each copy sheet on the collecting tray, thereby substantially reducing customer acceptability and convenience.

By the present invention, sheet handling and stacking performance can be accomplished with improved, positive sheet control by applying a normal force against the sheet while the lead edge of the sheet is located within the receiving slot of the disk. The following disclosures may be relevant to various aspects of the present invention:

U.S. Pat. No. 5,065,997

Patentee: Butts et al.

Issued: Nov. 19, 1991

U.S. Pat. No. 5,114,135

Patentee: Evangelista et al.

Issued: May 19, 1992

U.S. Pat. No. 5,280,901

Patentee: Smith et al.

Issued: Jan. 25, 1994

The relevant portions of the foregoing disclosures may be briefly summarized as follows:

U.S. Pat. No. 5,065,997 discloses a sheet inverter and stacking apparatus including at least one sheet inverter wheel having at least one arcuate sheet retaining slot into which a sheet may be inserted and a roller assembly located in the entrance to the arcuate retaining slot for providing minimal resistance to sheet movement in the slot in the process direction while providing high resistance to sheet movement in the slot in a sideways direction, transverse to the process direction.

U.S. Pat. No. 5,114,135 discloses a registration assist device for pressing a sheet located in the slot of as disk against a surface of the disk for a time period which begins prior to and extends until just after the time when a leading edge of the sheet contacts a registration wall which strips the sheet from the disk slot. Pressing the sheet against a surface or,the disk causes a drag force to be applied to the sheet so that the leading edge of the sheet is re-registered with a registration wall to compensate for any movement of the sheet away from the registration wall after initial contact therewith.

U.S. Pat. No. 5,280,901 discloses a sheet feeding and corrugating system including a sheet feeding nip comprising plural spaced sheet feeding rollers and freely mounted spherical balls wherein the spherical balls are freely mounted in generally vertical ball retainers to provide sheet corrugation which varies automatically with the stiffness of the sheet passing through the sheet feeding system.

As xerographic technology grows, other copier and printer machines are being provided with increased speed and with more highly automated features. As such, it has become increasingly important to provide higher speed yet more reliable automated handling of output copy sheets. In addition, since misregistration, especially skewing, can adversely affect further feeding, ejection, and/or proper stacking of copy sheets avoiding of undesired sheet skewing during feeding and maintaining proper copy sheet registration while providing non-slip feed timing of sheets is also important. Whether that copier or print machine is a relatively slow or exceptionally fast copy rate machine, customers expect copy sheets to exit a copier or print machine in an orderly and organized manner, with reliability and without jamming.

In accordance with the present invention, a disk stacking apparatus is disclosed, comprising: a rotatable disk unit including a receiving slot for receiving a sheet therein; means for rotating the rotatable disk unit; and a passive registration assist system, responsive to gravitational forces, for applying a normal force against a sheet positioned in the receiving slot.

In another aspect of the invention, there is disclosed an apparatus for restraining movement of a sheet positioned in a slot on a rotating disk-type stacking member, comprising a reciprocating boss member, adapted to be shifted, under the influence of gravity, from a non-operative position spaced from the slot, to an operative position extending into the slot, with the copy sheet positioned therein, for applying a normal force against the copy sheet in response to rotational movement of the stacking member.

In yet another aspect of the invention, an electrostatographic printing machine including a disk-type sheet stacking apparatus is disclosed, comprising: a rotatable disk unit including a receiving slot for receiving a sheet therein; means for rotating the rotatable disk unit; and a passive registration assist system, responsive to gravitational forces, for applying a normal force against a sheet positioned in the receiving slot.

In another aspect of the invention, an electrostatographic printing apparatus is disclosed, including a copy sheet transport and delivery module having a rotating disk-type stacking member, comprising an apparatus for restraining movement of a sheet positioned in a slot on a rotating disk-type stacking member, wherein a reciprocating boss member, adapted to be shifted, under the influence of gravity, from a non-operative position spaced from the slot, to an operative position extending into the slot, with the copy sheet positioned therein, is provided for applying a normal force against the copy sheet in response to rotational movement of the stacking member.

These and other aspects of the present invention will become apparent from the following description in conjunction with the accompanying drawings in which.

Figure 1:
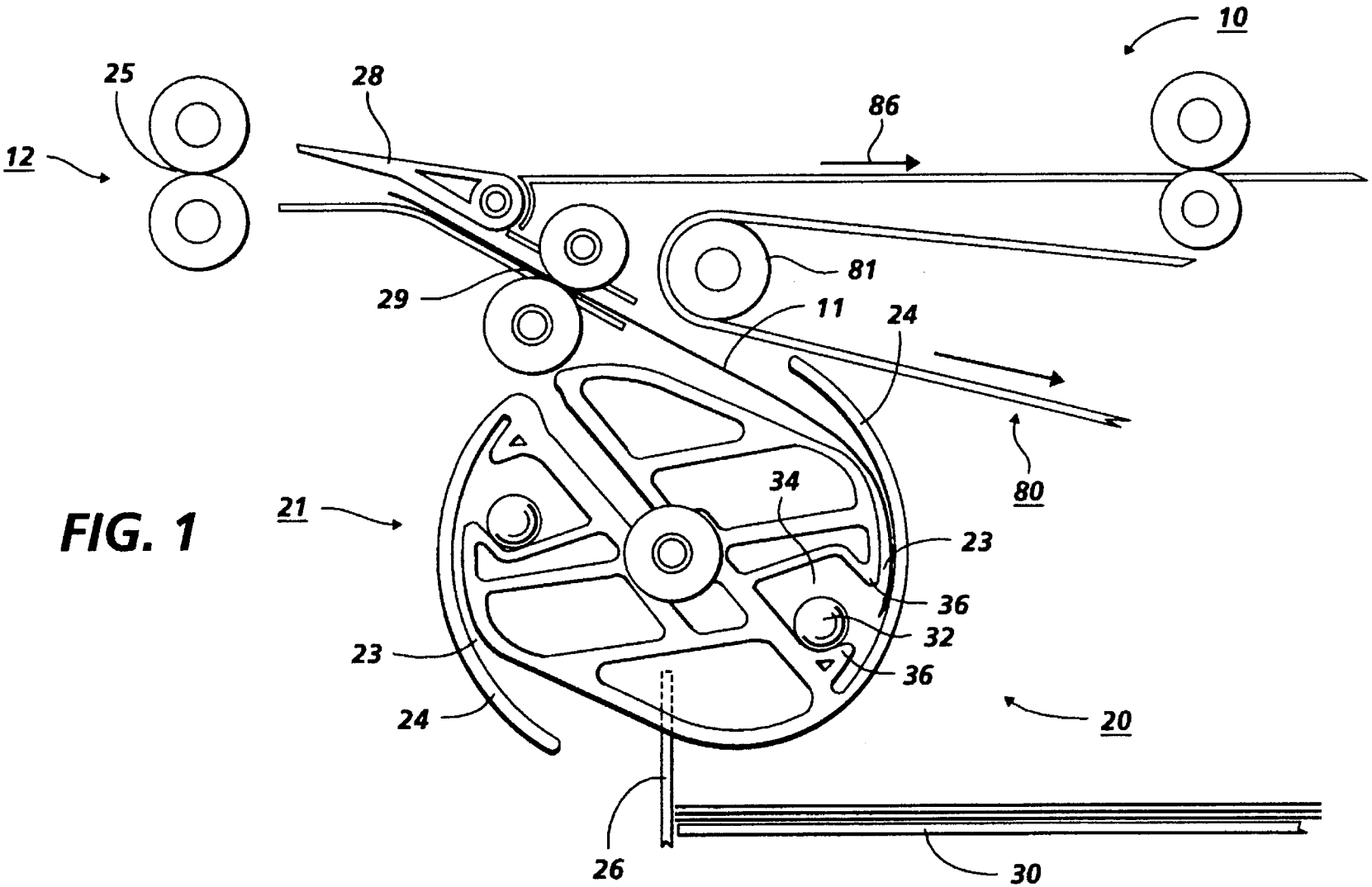
FIG. 1 is an enlarged schematic side view of a disk-type sheet stacking apparatus in accordance with the present invention, showing the passive sheet registration assist system thereof.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout to designate identical elements. It is further noted that all references cited in this specification, and their references, are hereby incorporated by reference where appropriate for relevant teachings of additional or alternative details, features, and/or technical background.

Figure 5:
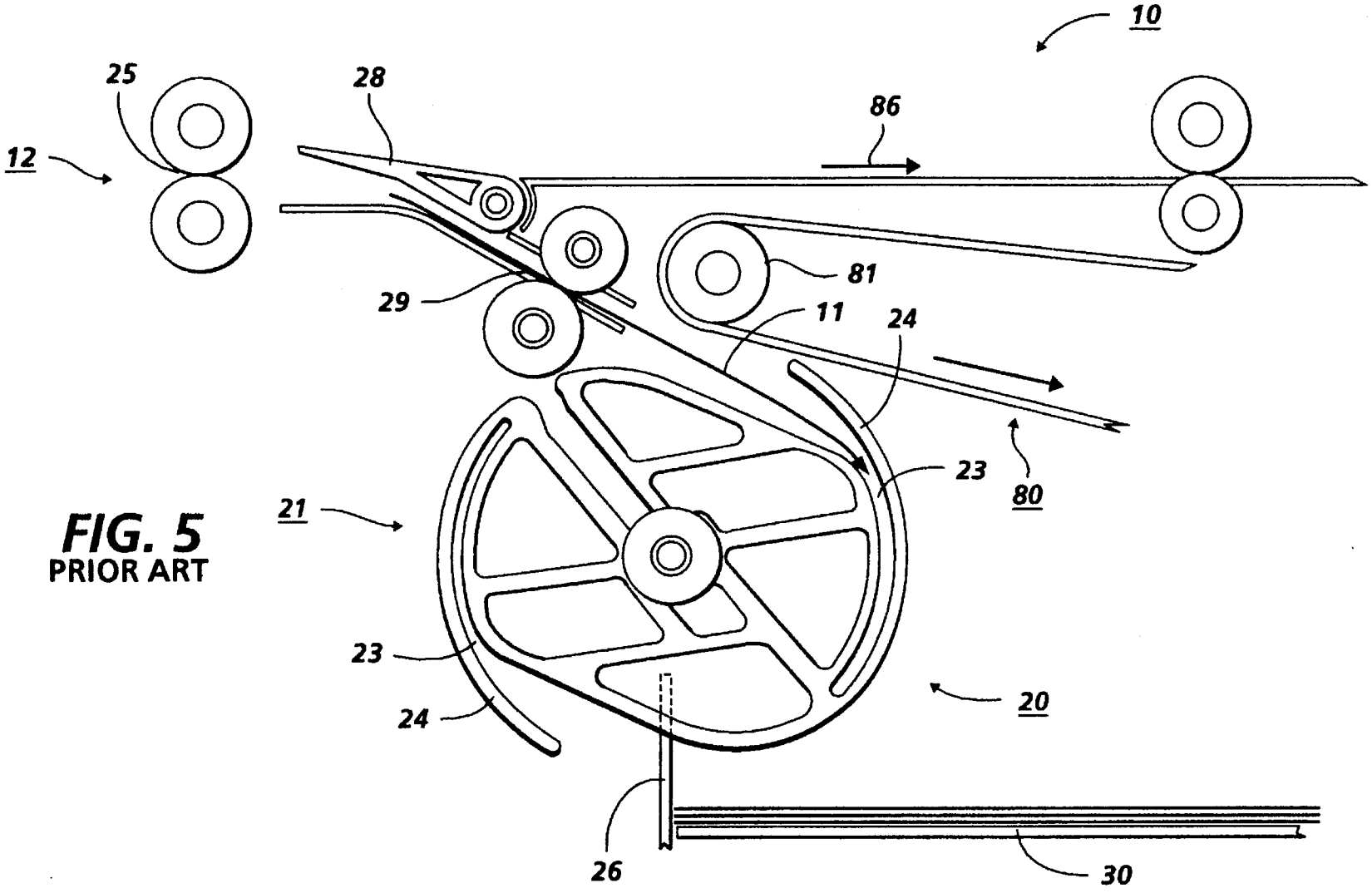
FIG. 5 PRIOR ART
FIG. 5 is an enlarged schematic side view of one embodiment of a prior art disk stacking system, showing a copy sheet entering the rotating disk.
Figure 6:
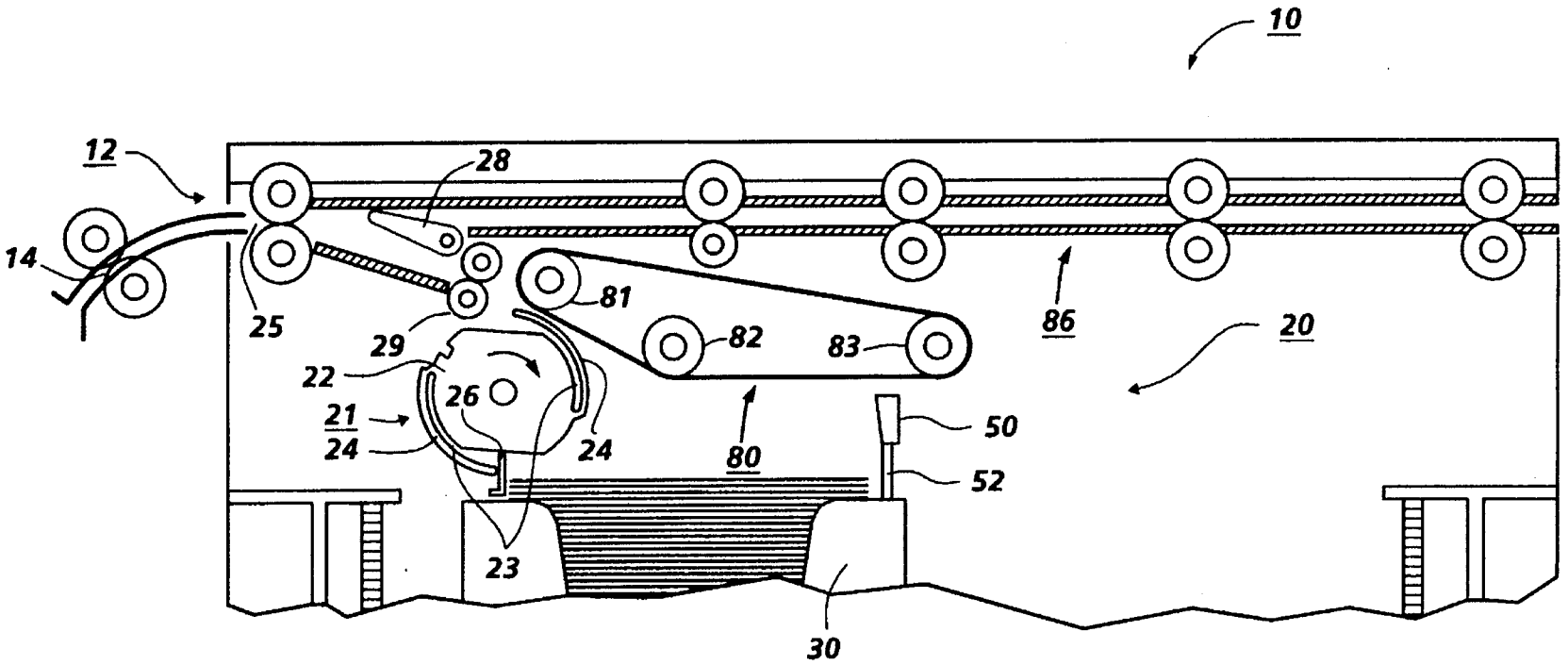
FIG. 6 PRIOR ART
FIG. 6 is a schematic representation, in cross-section, of a copy sheet output section as typically used in an automatic electrostatographic printing machine, employing a disk-type sheet inverter and stacking apparatus.

For a general understanding of the copy sheet output section of an electrostatographic printing machine and, in particular, a typical disk stacker of the type in which the features of the present invention may be incorporated, reference is initially made to FIGS. 5 and 6 prior to providing a description of the specific features of the present invention. It is noted that, although the apparatus of the present invention is particularly well adapted for use in an automatic electrostatographic reproducing machine and will be described in the context thereof, it will become apparent from the following discussion that the disk stacking apparatus disclosed herein is equally well suited for use in a wide variety of copy or print machines as well as in any other system utilizing a rotating disk-type sheet delivery apparatus.

FIGS. 5 and 6 illustrate the basic components of an exemplary copy sheet output section comprising a copy sheet transport and delivery module 10 which typically receives output copy sheets 11 through a feeder section 12 via feed rollers 14 and 25. This feeder section 12 can represent a conventional high speed copier or printer. The copy sheet transport and delivery module 10 includes a disk stacker section 20 comprising a rotating disk unit 21 having one or more arcuate fingers 24 located along the periphery of the disk unit 21 defining arcuate receiving slots 23 for receiving output copy sheets 11 therein. In addition, the disk stacker section 20 also includes an overhead trail edge transport system comprising a belt 80 extending along a curvilinear path defined by rollers 81, 82, 83, at least one of which being driven by a motor (not shown). The copy sheet transport and delivery module 10 also includes a bypass transport idler assembly, generally indicated by reference numeral 86, made up of a plurality of pairs of bypass rollers for driving sheets past the disk stacking section 20 to an alternative location, such as another disk stacker or a document finishing apparatus. A bypass deflector gate 28 is provided for being selectively positioned to deflect the copy sheets either into the bypass transport assembly 86 or into the disk stacker section 20. In the latter case, input rollers 29 feed a copy sheet into receiving slot 23 of disk unit 21.

By way of description of the operation of a typical disk stacker, a copy sheet 11 exits an upstream device, such as a printer or copier through output rollers 14, entering the disk stacker module 10 through feeder section 12 where the sheet is engaged by one or more pairs of disk stacker input rollers 25. Assuming the bypass deflector gate 28 is positioned so as to deflect the copy sheet into the disk stacker section 20, as shown, the copy sheet 11 is then transported into contact with input rollers 29 which drive the sheet into receiving slot 23 of disk unit 21. After a sheet is fed into a receiving slot 23, the disk unit 21 rotates to invert and transport the sheet until the leading edge of the sheet is positioned against a fixed registration wall 26. The registration wall 26 strips the sheet from the rotatable disk unit 21 as the disk continues to rotate through openings in the fixed wall 26, thereby allowing the sheet to drop onto the top of a stack of previously inverted sheets, as shown. The rotational movement of disk unit 21 can be controlled by various conventional devices known in the art, such as a stepper motor or a cam drive mechanism. Preferably a sensor is located upstream of disk unit 21 for detecting the presence of a sheet approaching the disk unit 21. The disk input rollers 29 operate at a constant velocity such that the time required for the sheet 11 lead edge to reach the disk slot after detection by the sheet sensor can be easily determined. Thereafter, as the lead edge of the sheet 11 begins to enter the slot 23, the disk rotates through a 180° cycle.

In addition to the sheet transport and inversion movement provided by the rotation of disk unit 21, the trail edge of the sheet 11 is transported into contact with trail edge assist belt 80 which rotates in a direction such that contact between the transport belt 80 and the trail edge of a copy sheet 11 assists in the inversion and transport of the copy sheet 11. Essentially, the trail edge assist transport system enhances sheet transport by contacting the trail edge of the sheet 11 along the desired path of travel of sheet 11 desires to follow and provides compensation for sheet sag so that the entire sheet is simultaneously inverted and transported until it is deposited into collecting tray 30. The configuration and velocity of the trail edge assist transport belt 80 may be optimized to prevent long, lightweight sheets from collapsing before they are entirely inverted or to prevent heavier weight sheets from stubbing on overhead components of the disk stacker 20, as discussed in detail in commonly assigned U.S. Pat. No. 5,114,135. The trail edge assist system is also provided with a trail edge guide 50 including an oscillating member 52 which functions to align sheets on the stack against the front registration wall 26. Preferably, trail edge guide 50 is movably mounted for accommodating sheets of different lengths in the disk stacker 20. In addition, a typical disk stacker unit 20 also includes a tamping mechanism (not shown) which is capable of offsetting sets of sheets in a direction perpendicular to the process direction for providing some demarcation of plural related sheets, usually referred to as a "set" or a "job".

Turning now to a detailed description of the present invention, it will be noted from FIG. 1, that the disk unit 21 of the present invention is provided with a passive sheet registration system in the form of a freely mounted reciprocating boss member 32 situated within a retaining cavity 34 located in the body of the disk unit 21. The retaining cavity 34 includes a pair of retaining lips 36 defining an opening adjacent to receiving slot 23 and opposite arcuate finger 24. As will be discussed in detail hereinbelow, the reciprocating boss member 32 provides means for registering a sheet 11 within the receiving slot 23 by pressing the sheet 11 against a surface of the slot 23 opposite the opening defined by lips 36 with the sheet 11 lead edge positioned in the disk slot 23.

As can be seen from the FIGS., a typical disk stacker of the type contemplated by the present invention includes two arcuate receiving slots 23 for receiving and inverting sheets input thereto. For the purposes of the present discussion, the present invention will be described in detail with respect to only one receiving slot, with the understanding that the rotating disk unit 21 may include a plurality of receiving slots, each having a passive registration system in accordance with the present invention. Thus, as previously discussed, the passive registration system of the present invention includes a freely mounted reciprocating boss member 32 situated within a retaining cavity formed in and defined by the body of the disk unit 21. The retaining cavity 34 includes a pair of opposed retaining lips 36 defining an aperture having a reduced internal dimension relative to retaining cavity 34 which allows a portion of the reciprocating boss member to protrude into the receiving slot 23 and preferably against the innermost surface of arcuate finger 24.

Figure 2:
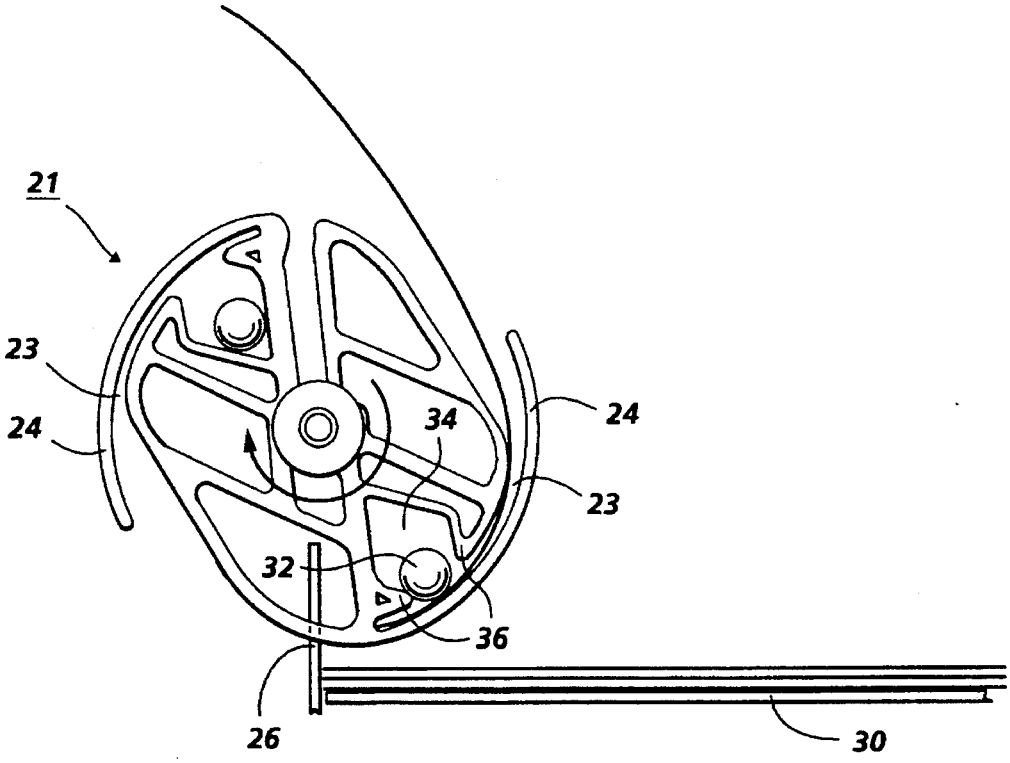
FIGS. 2–4 show the sheet stacking apparatus of the present invention at various points during the rotation thereof, illustrating the sheet inversion and stacking process.

The operation of the passive registration system of the present invention as defined by the components defined hereinabove will be described with reference to FIGS. 1–4. Initially, as shown in FIG. 1, copy sheet 11 is transported into receiving slot 23 via input rollers 29. The disk unit 21 is rotated as the copy sheet 11 travels into receiving-slot 23 so that the copy sheet 11 progressively travels into the receiving slot 23 until the lead edge of the sheet 11 contacts the base of receiving slot 23, as shown in FIG. 2. At the point which the copy sheet 11 is no longer in contact with input rollers 29 such that the copy sheet 11 moves solely under the influence of the disk unit 21, the disk 21 unit has rotated sufficiently to allow gravitational forces to act on boss member 32, causing the boss member 32 to travel into its operative position, protruding through the aperture formed by retaining lips 36 and extending into receiving slot 23 for exerting a normal force against the copy sheet 11. This normal force exerts pressure against the copy sheet, which, in turn, maintains the copy sheet in a substantially fixed position relative to the receiving slot 23. It is noted that boss member 32 comprises a freely movable body which may take the form of a weighted spherical ball, a cylindrical roller or any other freely movable shape as may be appropriate with respect to the configuration of the disk and/or cavity. However, it is important that the boss member 32 be free to move in an unobstructed manner within the retaining cavity so that gravitational forces will be sufficient to move the boss member 32 into, as well as out of, the operative position.

Figure 3:
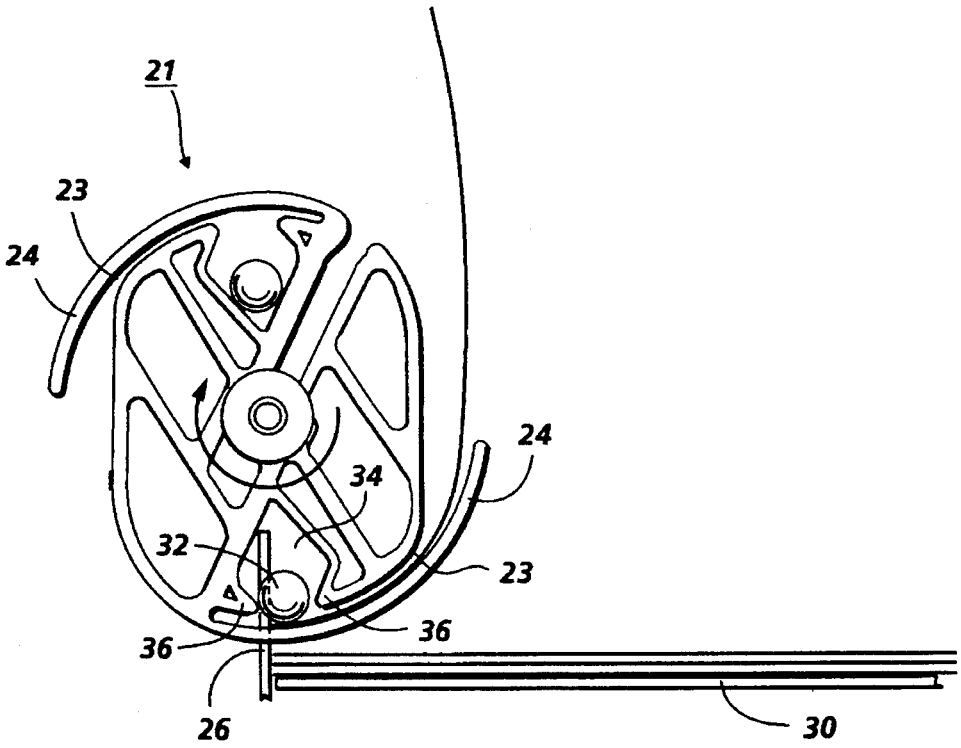

Referring now to FIG. 3, as disk unit 21 continues to rotate, copy sheet 11 continues to travel in engagement with the disk unit 21, and the leading edge of the copy sheet 11 eventually comes into contact with registration wall 26. Registration wall 26 is a fixed member which operates to strip the copy sheet 11 from the receiving slot 23 by contacting the leading edge of the copy sheet 11 and preventing continued transport thereof as the disk unit 21 continues to rotate. At this position, boss member 32 also rotates in contact with the copy sheet 11 as the disk unit 21 continues to rotate so as to maintain a normal force against the copy sheet 11 while the copy sheet 11 becomes disengaged from the disk unit 21. It is noted that the orientation of the components of the passive registration system is such that the boss member 32 is not normally ever seated against retaining lips 36 so that rotational motion of the boss member is not obstructed.

Figure 4:
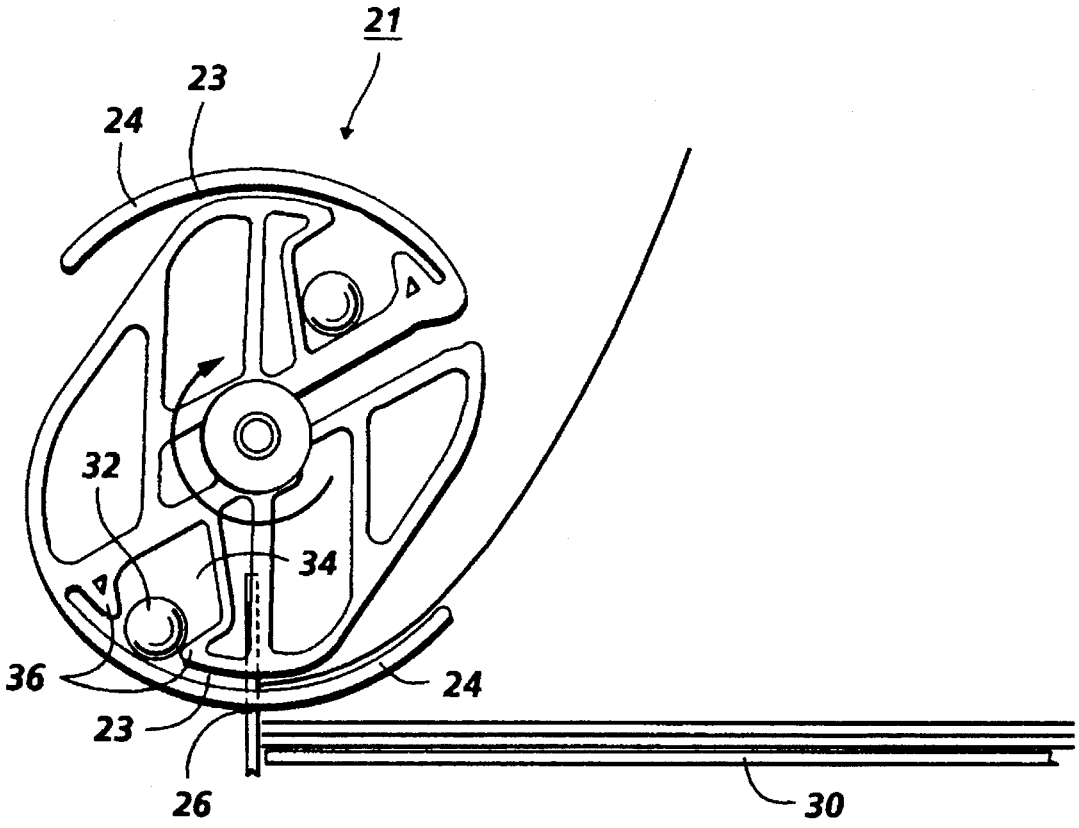

In a final step, as shown in FIG. 4., the disk unit 21 continues to rotate such that boss member 32 is no longer in contact with copy sheet 11. Continued rotation of the disk unit 21 permits gravitational forces to act on the boss member, thereby causing the boss member to retreat into the retaining cavity 36 such that the receiving slot 23 is clear for receiving the next copy sheet.

The orientation of the components of the passive registration system is such that the reciprocating boss member 32 is allowed to move freely within the retaining cavity 34 under the forces of gravity such that the boss member 32 shifts between a non-operative position within the cavity 34 to an operative position protruding from cavity 34. With the boss member 32 in the operative position, a normal force is applied against the innermost surface of arcuate finger 24, thereby pressing a sheet 11 positioned in receiving slot 23 against the arcuate finger 24 to maintain the sheet 11 in position with the slot 23.

It will be understood by one of skill in the art that, if the boss member 32 comprises a spherical ball, lateral sheet movement within the receiving slot would be permitted as may be desirable in certain applications. That is, since a ball would be free to rotate with the retaining lips 36, lateral rotation thereof would permit lateral side shifting of the copy sheet 11 in the receiving slot 23 for lateral job offsetting. Details of side shifting mechanisms are disclosed in various patents and other publications which may be incorporated into a copy sheet transport and delivery module as disclosed herein to the extent consistent with the advantageous features disclosed herein. Conversely, in certain applications it may be undesirable to permit such lateral sheet movement such that roller members or other configurations may be desirable.

In recapitulation, the disk stacking apparatus of the present invention includes a passive registration system comprising a boss member situated in a retaining cavity in a rotating disk. Movement of the boss member within the retaining cavity is unrestricted and unresisted such that gravitational forces are allowed to act on the boss member as the disk rotates, causing the boss member to shift from an operative position, applying a normal force against a copy sheet located in engagement with the disk, to a non-operative position within the confines of the retaining cavity as the disk continues to rotate, releasing the copy sheet from engagement with the disk. The reciprocating boss member exerts a normal force against the copy sheet while the copy sheet is inserted within the receiving slot 23 to eliminate movement of the sheet 11 therein. The passive registration feature provided by the present invention enables reliable sheet feeding and accurate registration of sheets of various sizes, types, weights, and materials and also provides for avoidance of undesired sheet skewing during stacking, while maintaining proper registration and non-slip feed timing of sheets which can affect further feeding,-ejection, and/or proper stacking of the sheets. These beneficial results are provided while adding little or no cost to the disk stacker unit. This passive registration system of the present invention may also provide the potential for eliminating superfluous parts found in a typical sheet transport and delivery module, such as the oscillating registration member 50.

It is therefore evident that there has been provided, in accordance with the present invention, a disk stacking apparatus that fully satisfies the aims and advantages of the invention as set forth hereinabove. While this invention has been described in conjunction with a preferred embodiment thereof, it is evident that many alternatives, modifications, and variations will be apparent to those skilled in the art. Accordingly, the present application for patent is intended to embrace all such alternatives, modifications and variations as are within the broad scope and spirit of the appended claims.

We claim:

1. A disk-type sheet stacking apparatus, comprising:

a rotatable disk unit including a receiving slot for receiving a sheet therein;

means for rotating said rotatable disk unit; and passive registration assist means, responsive to gravitational forces, for applying a normal force against a sheet positioned in the receiving slot, wherein said passive registration assist means includes a reciprocable boss member for applying the normal force against the sheet, said boss member being periodically positioned, in response to gravitational forces, in the receiving slot with a sheet inserted therein; and retaining means for housing said boss member in a freely movable configuration within said rotatable disk unit.

2. The disk-type stacking apparatus of claim 1, wherein said retaining means includes a retaining cavity having retaining lips defining an opening in the retaining cavity adjacent to the receiving slot, such that said boss member protrudes through the opening, in response to gravitational forces, for applying the normal force against the sheet inserted in the receiving slot.

3. The disk-type stacking apparatus of claim 1, wherein said reciprocable boss member includes a substantially spherical ball.

4. The disk-type stacking apparatus of claim 1, wherein said reciprocable boss member includes a substantially cylindrical roll member.

5. The disk-type stacking apparatus of claim 1, further including a registration wall for stripping the sheet from the receiving slot as the rotatable disk unit continues to rotate so as to align a lead edge of the sheet in a stacked position.

6. An apparatus for restraining movement of a sheet positioned in a slot on a rotating disk-type stacking member, comprising:

a reciprocating boss member, adapted to be shifted, under the influence of gravity, from a non-operative position spaced from the slot, to an operative position extending into the slot, with the copy sheet positioned therein, for applying a normal force against the copy sheet in response to rotational movement of the stacking member.

7. The apparatus of claim 6, wherein the rotating disk-type stacking member further includes a retaining cavity for housing said reciprocating boss member, the retaining cavity having retaining lips defining an opening in the retaining cavity adjacent to the slot, such that said reciprocating boss member protrudes through the opening, in response to gravitational forces, for applying the normal force against the sheet inserted in the slot.

8. The apparatus of claim 6, wherein said reciprocating boss member includes a substantially spherical ball.

9. The apparatus of claim 6, wherein said reciprocating boss member includes a substantially cylindrical roll member.

10. An electrostatographic printing machine including a disk-type sheet stacking apparatus, comprising:

a rotatable disk unit including a receiving slot for receiving a sheet therein;

means for rotating said rotatable disk unit; and passive registration assist means, responsive to gravitational forces, for applying a normal force against a sheet positioned in the receiving slot, wherein said passive registration assist means includes a reciprocable boss member for applying the normal force against the sheet, said boss member being periodically positioned, in response to gravitational forces, in the receiving slot with a sheet inserted therein; and retaining means for housing said boss member in a freely movable configuration within said rotatable disk unit.

11. The electrostatographic printing machine of claim 10, wherein said retaining means includes a retaining cavity having retaining lips defining an opening in the retaining cavity adjacent to the receiving slot, such that said reciprocable boss member protrudes through the opening, in response to gravitational forces, for applying the normal force against the sheet inserted in the receiving slot.

12. The electrostatographic printing machine of claim 10, wherein said reciprocable boss member includes a substantially spherical ball.

13. The electrostatographic printing machine of claim 10, wherein said reciprocable boss member includes a substantially cylindrical roll member.

14. The electrostatographic printing machine of claim 10, further including a registration wall for stripping the sheet from the receiving slot as the rotatable disk unit continues to rotate so as to align a lead edge of the sheet in a stacked position.

15. An electrostatographic printing machine, including a copy sheet transport and delivery module having a rotating disk-type stacking member, comprising:

an apparatus for restraining movement of a sheet positioned in a slot on a rotating disk-type stacking member, including:

a reciprocating boss member, adapted to be shifted, under the influence of gravity, from a non-operative position spaced from the slot, to an operative position extending into the slot, with the copy sheet positioned therein, for applying a normal force against the copy sheet in response to rotational movement of the stacking member.

16. The electrostatographic printing machine of claim 15, wherein the rotating disk-type stacking member further includes a retaining cavity for housing said reciprocating boss member, the retaining cavity having retaining lips defining an opening in the retaining cavity adjacent to the slot, such that said reciprocating boss member protrudes through the opening, in response to gravitational forces, for applying the normal force against the sheet inserted in the slot.

17. The electrostatographic printing machine of claim 15, wherein said reciprocating boss member includes a substantially spherical ball.

18. The electrostatographic printing machine of claim 15, wherein said reciprocating boss member includes a substantially cylindrical roll member.

* * * * *